US009517856B2

(12) United States Patent
Giuliani

(10) Patent No.: US 9,517,856 B2
(45) Date of Patent: Dec. 13, 2016

(54) UNIT FOR APPLYING GLUE ON LABELS AND CONVEYING SUCH LABELS

(75) Inventor: Mattia Giuliani, Parma (IT)

(73) Assignee: SIDEL S.p.A. con Socio Unico, Parma (IT)

( * ) Notice: Subject to any disclaimer, the term of this patent is extended or adjusted under 35 U.S.C. 154(b) by 340 days.

(21) Appl. No.: 13/516,063

(22) PCT Filed: Dec. 16, 2009

(86) PCT No.: PCT/IT2009/000567

§ 371 (c)(1),
(2), (4) Date: Aug. 14, 2012

(87) PCT Pub. No.: WO2011/074019

PCT Pub. Date: Jun. 23, 2011

(65) Prior Publication Data

US 2013/0032294 A1 Feb. 7, 2013

(51) Int. Cl.
*B65C 3/16* (2006.01)
*B65C 9/22* (2006.01)
(Continued)

(52) U.S. Cl.
CPC . *B65C 9/16* (2013.01); *B65C 3/16* (2013.01); *B65C 9/2291* (2013.01); *Y10T 156/1702* (2015.01)

(58) Field of Classification Search
CPC ..... B65C 3/16; B65C 9/16; B65C 9/2291; B65C 9/26
(Continued)

(56) References Cited

U.S. PATENT DOCUMENTS 3,567,559 A * 3/1971 Dullinger ..... 156/571
3,800,400 A * 4/1974 Mistarz et al. ..... 29/426.3
(Continued)

FOREIGN PATENT DOCUMENTS

DE 19911074 A1 9/2000
DE 19758799 B4 3/2008
GB 2073137 A 10/1981

OTHER PUBLICATIONS

"International Application Serial No. PCT/IT2009/000567, International Search Report mailed Sep. 15, 2010", 3 pgs.
(Continued)

*Primary Examiner* — Mark A Osele
*Assistant Examiner* — Christopher C Caillouet
(74) *Attorney, Agent, or Firm* — Schwegman Lundberg & Woessner, P.A.

(57) ABSTRACT

There is described a unit for applying glue on a plurality of labels to be cold-glued on respective containers and for conveying labels applied with glue, comprising: a roll covered of glue and operable to rotate about a first axis; a first carousel operable to rotate about a second axis and which comprises, in turn, a plurality of paddles adapted to cooperate with roll to be covered with glue and to take a relative label from a storage; a second carousel operable to rotate about a third axis and which comprises, in turn, a plurality of hooks adapted to receive respective labels covered with glue from respective paddles and to move respective labels with glue applied thereon along a first path; at least a first belt operatively connected to first carousel and to one between roll and second carousel.

3 Claims, 6 Drawing Sheets

(51) Int. Cl.
*B65C 9/26* (2006.01)
*B65C 9/16* (2006.01)

(58) Field of Classification Search
USPC ..... 156/538, 539, 556
See application file for complete search history.

(56) References Cited

U.S. PATENT DOCUMENTS

| | | | | |
|---|---|---|---|---|
| 4,404,058 | A | 9/1983 | Marchini et al. | |
| 6,095,218 | A * | 8/2000 | Delmolino et al. | 156/353 |
| 6,357,985 | B1 * | 3/2002 | Anzani et al. | 414/331.05 |
| 2002/0175047 | A1 * | 11/2002 | Blumenthal et al. | 198/459.8 |
| 2008/0088448 | A1 * | 4/2008 | Steidinger | 340/572.1 |

OTHER PUBLICATIONS

"International Application Serial No. PCT/IT2009/000567, Written Opinion mailed Sep. 15, 2010", 3 pgs.

* cited by examiner

UNIT FOR APPLYING GLUE ON LABELS AND CONVEYING SUCH LABELS

PRIORITY CLAIM AND RELATED APPLICATIONS

This application is a nationalization under 35 U.S.C. 371 of PCT/IT2009/000567, filed Dec. 16, 2009, and published as WO 2011/074019 A1 on Jun. 23, 2011; which application and publication are incorporated herein by reference in their entirety.

TECHNICAL FIELD

The present invention relates to a unit for applying glue on labels to be cold-glued onto relative containers and for conveying such labels applied with glue.

BACKGROUND ART

Labelling machine are used to apply labels to articles of all sorts, particularly to containers for many liquid or powder products including not only food products such as milk, fruit juices or beverages in general, but also mineral lubricating or detergent oils.

Very briefly, labelling machines of the known type comprise a storage for labels to be applied onto respective containers, a unit for applying the glue onto the label and for conveying label with glue thereon towards respective containers, and a gluing group for cold-gluing the labels onto respective containers.

In greater detail, the unit comprises:

- a roll covered with glue and rotating about a first axis;
- a first carousel which rotates about a second axis and comprises a plurality of paddles adapted to subsequently cooperate with the roll so as to be covered with glue and to pick relative labels from the storage; and
- a second carousel which rotates about a third axis, and comprises a plurality of hooks which receive respective labels with glue thereon from first carousel and convey respective labels towards respective containers.

The first carousel is driven in rotation in a first direction by a motor while the roll and the second carousel are driven in rotation by the first carousel in a second direction which is opposite to the first direction.

Alternatively, the second carousel may be driven in rotation by a further motor.

More precisely, the motor drives in rotation a first gear which engages with two gear trains operatively connected respectively to the roll and to the second carousel.

Each gear train comprises a plurality of gears in order to ensure a proper reduction ratio between the angular speed of the first carousel and the angular speed of the roll and of the second carousel.

Furthermore, each gear train must perforce comprise at least an idler gear in order to ensure that the roll and the second carousel rotate in the second direction.

A need is felt in the industry to reduce the number of components necessary to transmit the motion between the first carousel and the second carousel, and between the first carousel and the roll, so as to reduce manufacturing costs, maintenance costs and the overall noise of the unit.

Furthermore, a need is felt in the industry to manufacture an unit which may easily and economically realize different positions of the roll and of the second carousel with respect to the first carousel.

Finally, each kind of labelling machine has a specific pitch between the containers and a specific number of hooks. On the contrary, the number of paddles is generally constant.

Therefore, the transmission ratio between the first and the second carousel depends on the pitch between the containers.

A need is felt in the industry to economically change the transmission ratio between the first and the second carousel.

It is an object of the present invention to provide a unit for applying glue on labels to be cold-glued onto relative containers and for conveying such labels applied with glue designed to meet at least one of the above-identified requirements in a straightforward, low-cost manner.

According to the present invention, there is provided a unit for applying glue on labels to be cold-applied onto relative containers and for conveying such labels applied with glue as claimed in claim 1.

BRIEF DESCRIPTION OF THE DRAWINGS

In the following a preferred, non-limiting embodiment of the present invention will be described by way of example with reference to the accompanying drawings, in which.

BEST MODE FOR CARRYING OUT THE INVENTION

Figure 1:
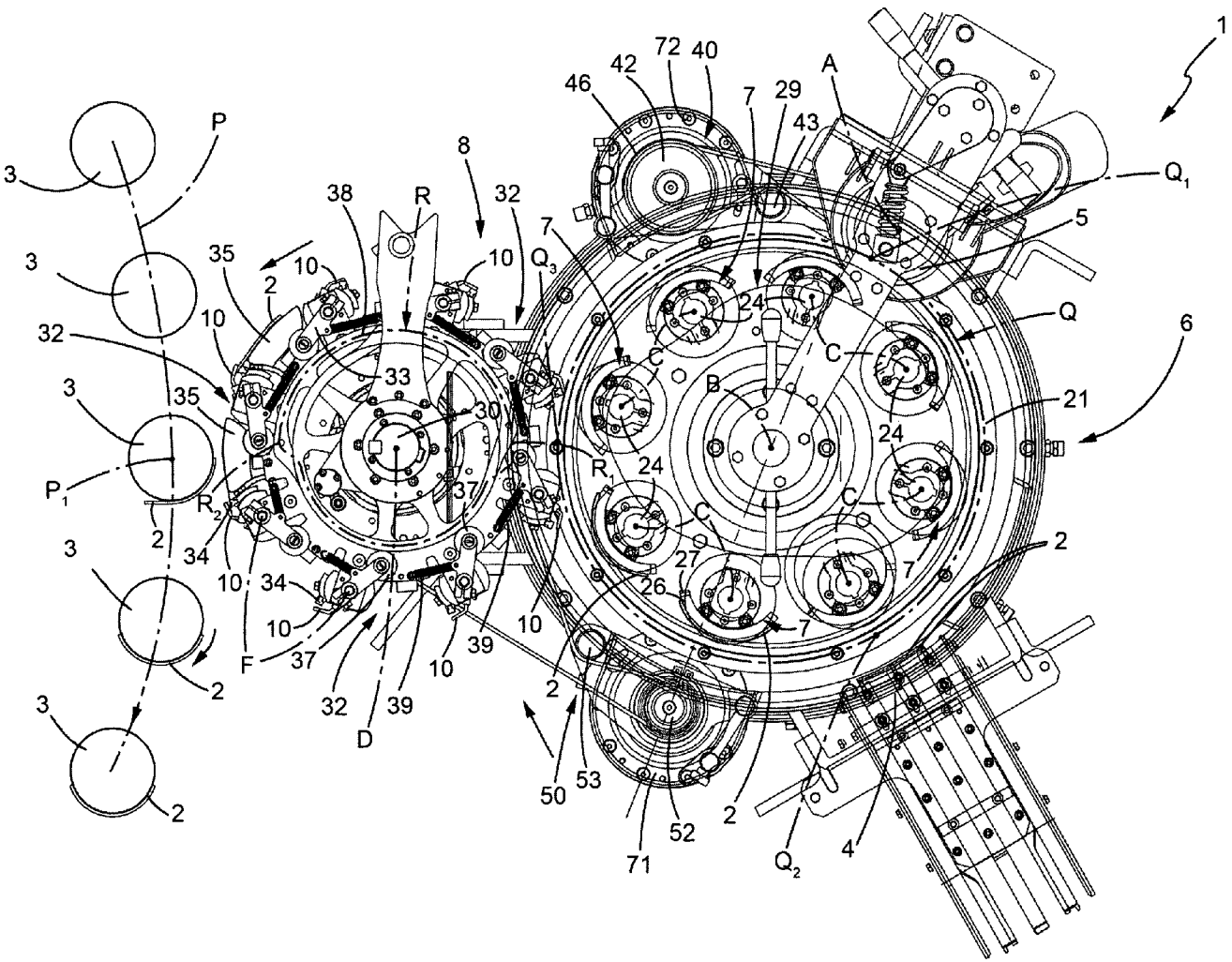
FIG. 1 is a top view of an unit for applying glue on labels to be cold-glued onto relative containers and for conveying such labels applied with glue according to the present invention.

Number 1 in the FIGS. 1 to 4 and 6 indicates as a whole a unit for applying glue on labels 2 to be cold-glued onto relative containers 3 and for conveying such labels 2 applied with glue.

More precisely, the locution "cold-applied" means that labels 2 are applied onto relative containers 3 at a temperature, which ranges about 20-25 centigrade degrees.

Container 3 may be pots, cans and the like.

Furthermore, containers 3 may be filled not only with food products such as milk, fruit juices or beverages in general, but also with mineral lubricating or detergent oils.

Unit 1 is adapted to be incorporated in a labelling machine (not shown). Labelling machine substantially comprises (FIG. 1):

- a conveyor (not shown) for conveying containers 3 along an arc-shaped path P which has an applying station $P_1$;
- a storage 4 for storing labels 2;
- unit 1; and
- a gluing group (not shown) for cold-applying labels 2 onto relative containers 3.

In greater detail, the not shown conveyor for conveying containers 3 substantially comprises a central wheel and a plurality of peripheral support element adapted to support respective containers 3.

More precisely, unit 1 cold-glues labels 2 onto relative containers 3 at station $P_1$. Containers 3 are then rotated about their own axes immediately downstream from station $P_1$ so as to facilitate the adhesion of relative labels 2 thereon.

Unit 1 substantially comprises:

- a roll 5 rotatable about an axis A in a first direction and covered with glue;
- a carousel 6 rotatable in a second direction opposite to the first direction about an axis B parallel to axis A, and comprising, in turn, a plurality of angularly equi-spaced paddles 7 each rotatable about a respective axis C parallel to axes A, B; and
- a carousel 8 rotatable in the first direction about an axis D parallel to axes A, B, and comprising, in turn, a plurality of angularly equi-spaced hooks 10.

Very briefly, each paddle 7 subsequently:

- cooperates with roll 5 so as to be covered with glue;
- cooperates with a relative frontal label 2 housed within storage 4 so as to cover such relative label 2 with glue;
- picks relative frontal label 2 from storage 4; and
- conveys relative label 2 towards carousel 8.

Afterwards, each hook 10 of carousel 8 receives a relative label 2 from a relative paddle 7, conveys relative label 2 along an arc-shaped path R and cold-glues such label 2 onto a relative container 3 at station $P_1$.

Figure 2:
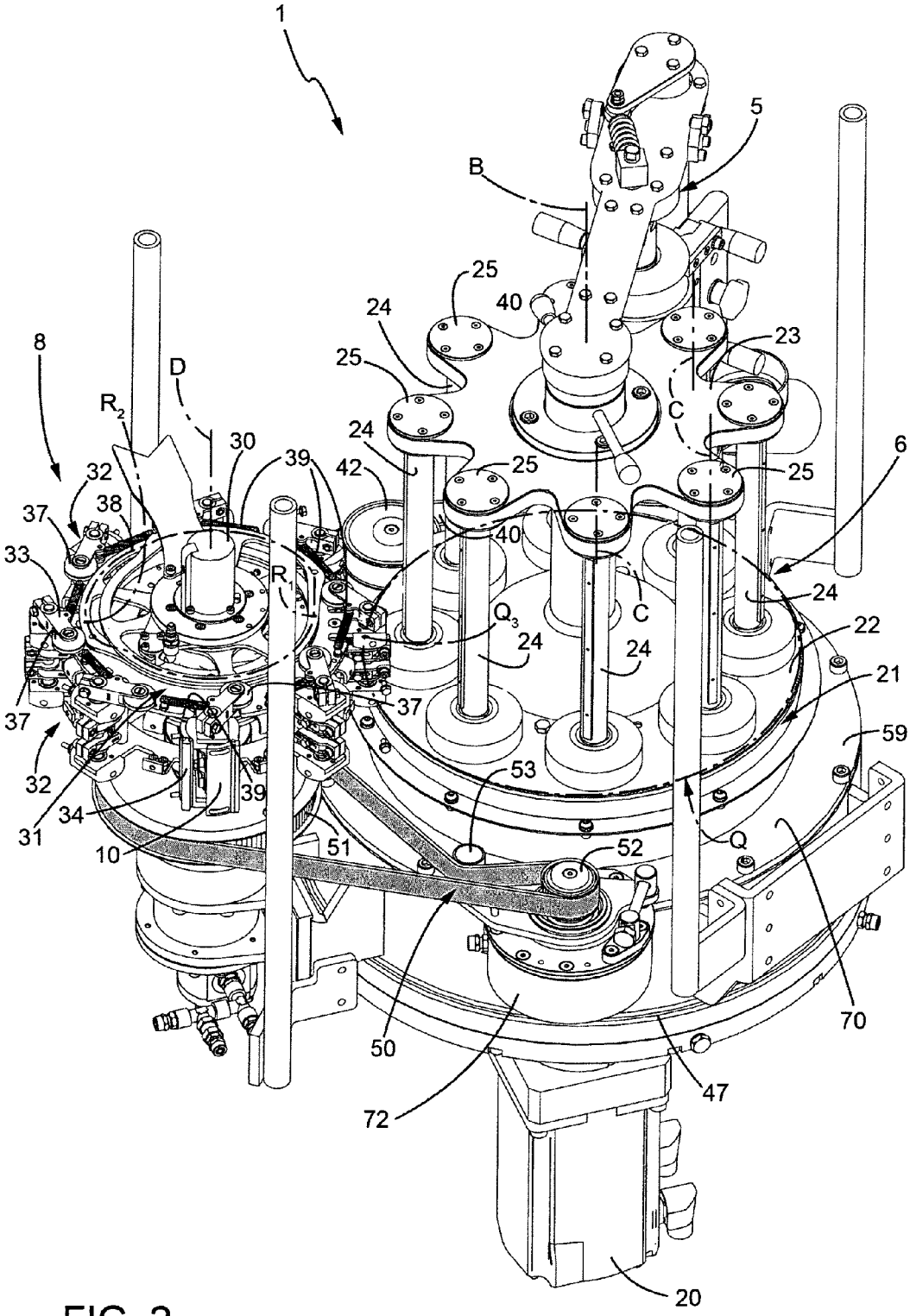
FIG. 2 is a perspective frontal view of the unit of FIG. 1.
Figure 3:
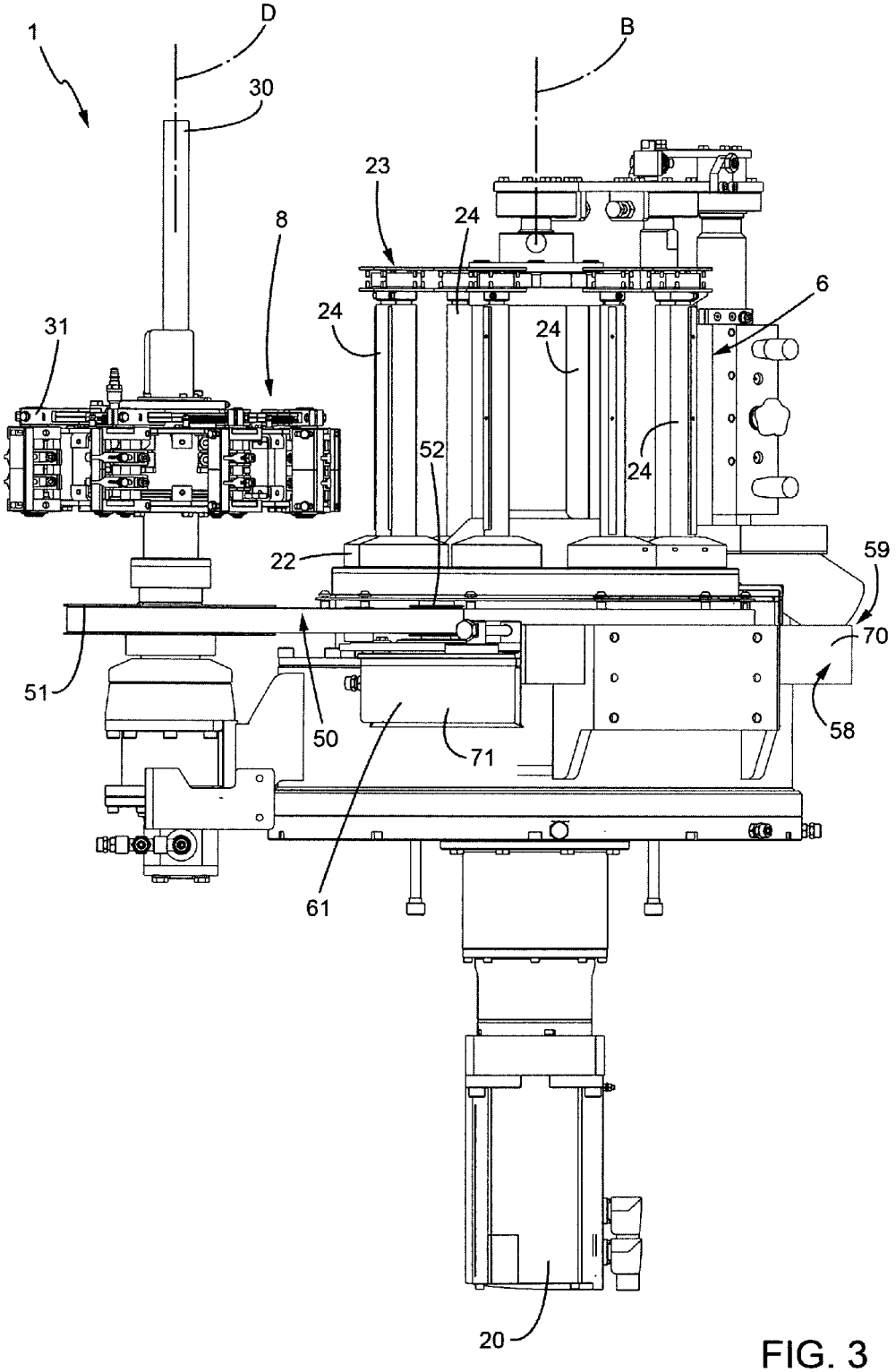
FIG. 3 is a frontal view of the unit of FIG. 2 with parts removed for clarity.

Carousel 6 substantially comprises (FIGS. 2 and 3:

- a motor 20 having an output element (not shown) rotating about axis B;
- a wheel 21 which comprises a bottom base 22 and a plate 23, and which is driven in rotation by motor 20;
- a plurality of angularly equi-spaced columns 24, eight in the embodiment shown, which extend about axis B vertically between base 22 and plate 23.

Unit 1 also comprises a stator 59 surrounding columns 24 and a fixed cam 29 (FIG. 1), which cooperates with a plurality of followers (not shown) integral with relative columns 24.

Columns 24 extend along respective axes C and are rotatably fitted about respective axes C to plate 23. More precisely, each column 24 is fitted to a flange 25 which may rotate relative to plate 23 about respective axis C.

More precisely, columns 24 rotate with respect to plates 23 and base 22 about respective axes C as carousel 6 rotates about axis A.

Paddles 7 are fitted to relative columns 24 and may pivot integrally with relative columns 24 with respect to wheel 21 about relative axes C.

Each paddle 7 extends parallel to axis C, and its section in a plane orthogonal to axis C is delimited by two circular arcs 26 and two segments 27 radial to respective arcs 26 and extending between arcs 26.

Carousel 6 drives in rotation paddles 7 along a path Q which comprises:

- a station $Q_1$ at which paddles 7 cooperate with roll 5 so as to be covered with glue;
- a station $Q_2$ at which paddles 7 pick relative frontal labels 2 from storage 4; and
- a station $Q_3$ at which paddles 7 release relative frontal labels 2 to relative hooks 8.

As they move along path Q, the interaction between cam 29 and followers causes the rotation of relative paddles 7 about respective axes C. Such rotation arranges paddles 7 in the correct position with respect roll 5 at station $Q_1$, storage 4 at station $Q_2$, and corresponding hook 10 of carousel 8 at station $Q_3$.

Carousel 8 substantially comprises:

- a shaft 30 rotating about axis D; and
- a wheel 31 fitted to shaft 30 and carrying a plurality of gripping elements 32 at its peripheral outer portion.

Unit 1 also comprises a fixed cam 38 which cooperates with a plurality of followers 37 of respective gripping elements 32.

Each gripping element 32 substantially comprises (FIG. 2):

- a lever 33;
- respective follower 37, which is connected to lever 33;
- an abutment element 34;
- a sponge 35 adapted to cooperate with respective label 2; and
- a respective hook 10 which is connected to lever 33.

In particular, each hook 10 may rotate about a respective axis F (FIG. 1) between a first position in which is detached from element 34 and a second position in which it presses relative label 2 against relative abutment element 34.

Gripping elements 32 are driven in rotation by carousel 8 along path R, which extend from a picking station $R_1$ to a release station $R_2$.

More precisely, hooks 10 of gripping elements 32 are arranged in the second position in the portion of the path R extending from station $R_1$ to station $R_2$, with reference to the rotation sense of carousel 8 shown in FIG. 1.

On the contrary, hooks 10 of gripping elements 32 are arranged in the first position in the portion of the path R extending from station $R_2$ to station $R_1$, with reference to the rotation sense of carousel 8.

As shown in FIG. 2, hooks 10 and abutment elements 34 extend parallel to direction F.

Gripping elements 32 are hold in the respective first positions by respective springs 39 and are moved in the respective second positions through the interaction of cam 38 with respective followers 37.

In particular, each gripping element 32 receives a relative label 2 from respective paddle 7 at picking station $R_1$ and cold-applies relative label 2 onto respective container 3 at release station $R_2$.

Picking station $R_1$ substantially coincides with station $Q_3$ while release station $R_2$ substantially coincides with station $P_1$.

Figure 6:
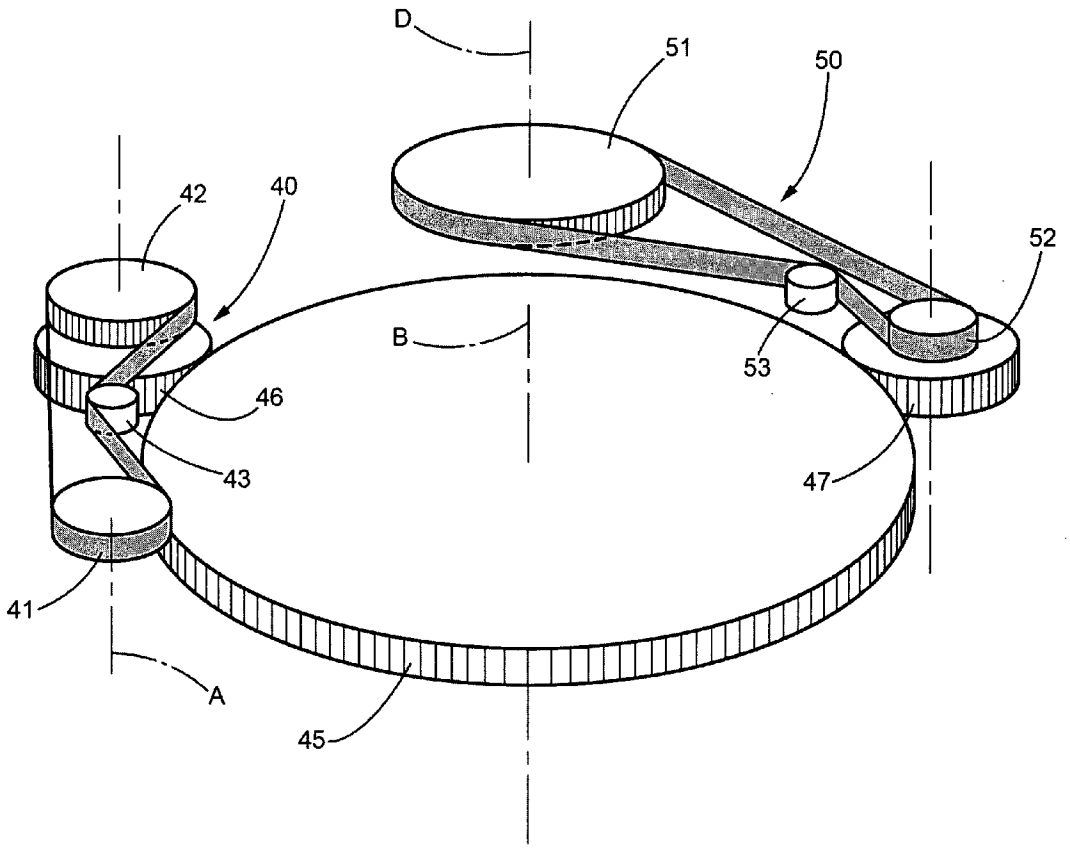
FIG. 6 is enlarged schematic view of some particulars of the unit shown in FIGS. 1 to 5.

Advantageously, unit 1 comprises a first belt 40 operatively connected to carousel 6 and to roll 5, and a second belt 50 operatively connected to carousel 6 and to carousel 8 (FIG. 6).

More precisely, carousel 6 comprises a gear 45 rotatable about axis B and operatively connected to motor 20, and unit 1 comprises a couple of gears 46, 47 meshing with gear 45.

Furthermore, unit 1 comprises:

- a pulley 41 angularly integral with roll 5 about axis A;
- a pulley 42 angularly integral and coaxial with gear 46;
- a pulley 51 angularly integral with wheel 31 of carousel 8 about axis D; and
- a pulley 52 angularly integral and coaxial with gear 47.

In particular, pulleys 41, 42, 51, 52 are toothed pulleys.

Belt 40 is wound onto pulleys 41, 42 while belt 50 is wound onto pulleys 51, 52.

Belts 40, 50 are tensioned by respective tightening pulleys 43, 53.

Stator 59 also comprises a one-piece element 58 which defines seats 60, 61, 62 for gears 45, 46, 47. (FIG. 4, 5, 6).

In particular, one-piece element 58 comprises a main circular body 70 of axis B and which defines seat 60, and a pair of appendixes 71, 72 which define respectively seats 61, 62. Appendixes 71, 72 extend on opposite lateral sides of body 70 and are external with respect to body 70.

Figure 4:
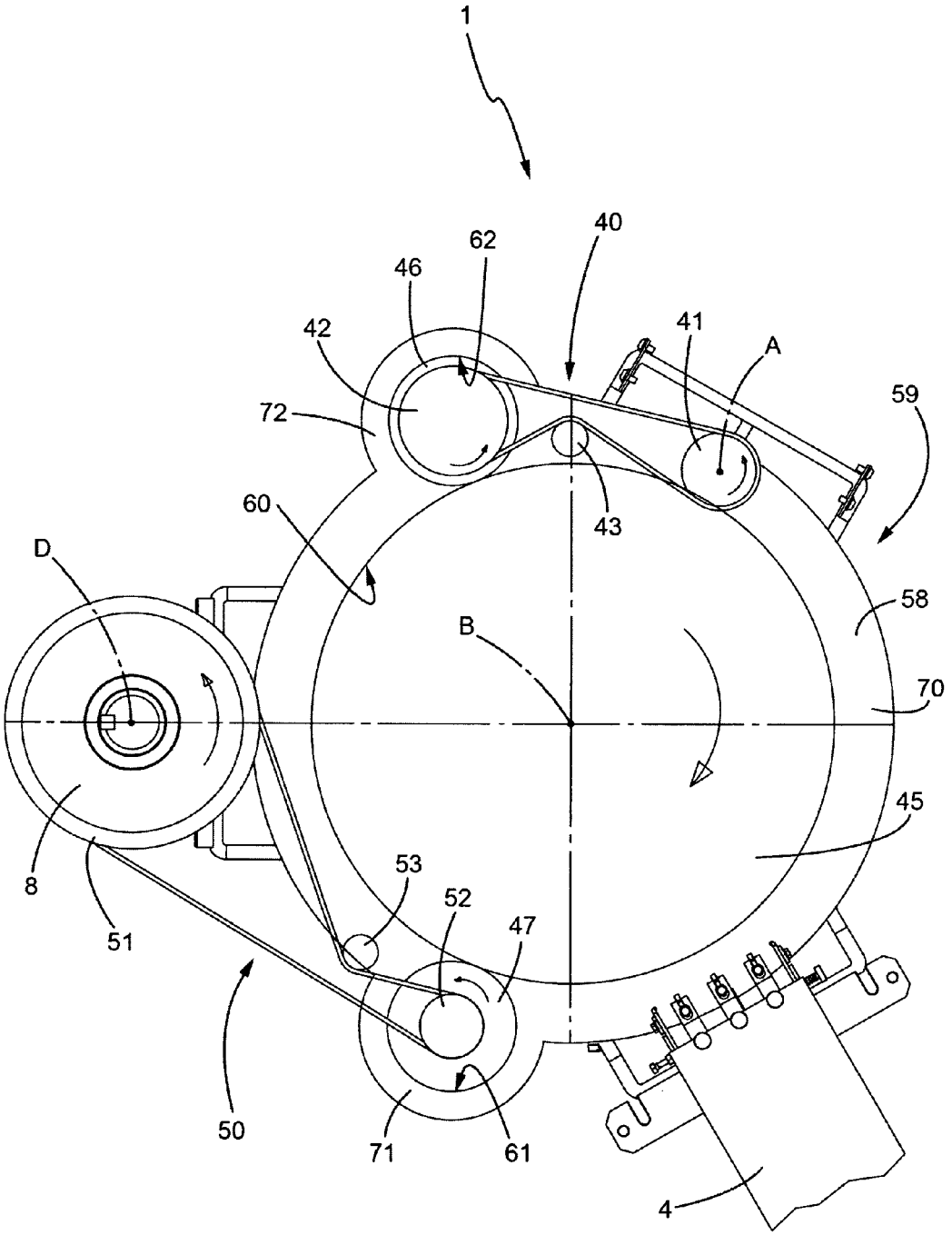
FIG. 4 is a schematically top view of the unit of FIGS. 1 to 3.
Figure 5:
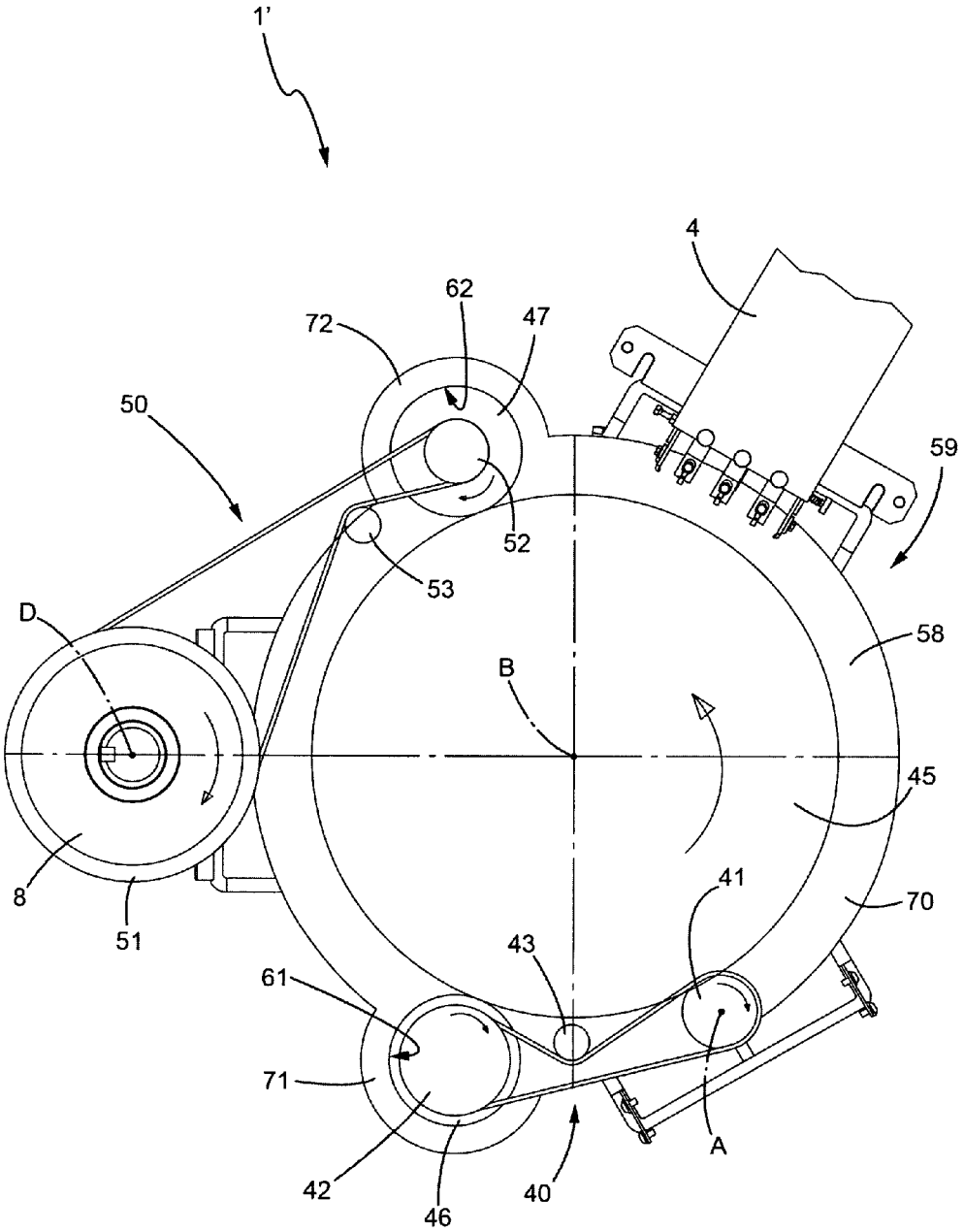
FIG. 5 is a schematically top view of a second embodiment of the unit of FIGS. 1 to 3.

As shown in FIG. 4, seat 60 houses gear 45, seat 61 houses gear 47, and seat 62 houses gear 46. Gears 45, 46, 47 are only schematically shown in FIGS. 4, 5, 6.

Accordingly, gear 46 is on a first side (top side) of axis B and gear 47 is on a second side (bottom side) opposite to first side of axis B.

Furthermore, roll 5 is on the first side of axis B while storage 4 is on the second side of axis B.

In use, motor 20 drives in rotation gear 45 and, therefore, carousel 6 in the first direction (clockwise in FIG. 4) about axis B.

At the same time, gear 45 drives in rotation gear 46 in the second direction (anticlockwise in FIG. 4). The rotation of gear 46 causes through belt 40 the rotation of pulleys 41, 42 in the second direction. The rotation of pulley 42 causes the rotation of roll 5 in the second direction about axis A.

In a completely analogous manner, gear 45 drives in rotation gear 47 in the second direction. The rotation of gear 47 causes through belt 50 the rotation of pulleys 51, 52 in the second direction. The rotation of pulley 52 causes the rotation of carousel 8 in the second direction about axis D.

The operation of the unit 1 will be then described with reference to only one paddle 7 and to the relative gripping element 32, hook 10, label 2 and container 3.

In particular, containers 3 are advanced along path P towards applying station $P_1$.

Motor 20 drives in rotation carousel 6 and paddle 7 about axis B and along path Q.

The interaction of cam 29 with the follower associated to paddle 7 causes the rotation of paddle 7 about axis C with respect to wheel 21.

In other words, paddle 7 rotates integrally with wheel 21 about axis B and along path Q, and rotates about axis C relative to wheel 21.

In particular, paddle 7 cooperates with the outer surface of roll 5 at station $Q_1$ so as to be covered with glue, spreads the glue on a first side of frontal label and picks label 2 with glue at station $Q_2$, and releases label 2 to hook 10 at station $Q_3$ which substantially coincides with station $R_2$.

Hook 10 is advanced by conveyor 8 along path R about axis D.

As hook 10 advances along path R, cam 38 cooperates with follower 37 of gripping element 32 to rotate hook 10 about axis F.

More precisely, hook 10 is conveyed in the first position from station $R_2$ to station $R_1$ and in the second position from station $R_1$ to station $R_2$, with reference to the rotation sense of carousel 8.

Hook 10 takes label 2 from paddle 7 at station $R_2$ and conveys label 2 up to station $R_1$.

At station $R_2$, hook 10 is moved to the second position and label 2 is transferred to container 3 which is arranged at station $P_1$.

Container 3 is rotated about its axis at station $P_1$ and the first side of label 2 is pressed by gluing group over the surface of container 3 so as to complete the adhesion of label 2 on the container 3.

With reference to FIG. 7, 1' indicates a unit according to a further embodiment of the present invention.

Unit 1' is similar to unit 1 and will be disclosed hereinafter only insofar as it differs from the latter; corresponding parts or equivalents of conveying units 1, 1' will be indicated, where possible, by the same reference numerals.

Unit 1' differs from unit 1 in that seat 62 houses gear 47, and seat 61 houses gear 46.

Accordingly, gear 47 is on the first side (top side) of axis B and gear 46 is on the second side (bottom side) opposite to first side of axis B.

Furthermore, storage 4 is on the first side of axis B and roll 5 is on the second side of axis B.

From an analysis of the features of unit 1, 1' made according to the present invention, the advantages it allows to obtain are apparent.

In particular, the rotation in the second direction of motor 20 and carousel 6 is transmitted to the rotation in the first direction of roll 5 and carousel 8 through belts 40, 50.

In this way, there is no need for idler gears to convert a rotation in a first direction into a rotation in the second direction and of a plurality of further gear-trains to achieve high reduction ratios between gear 45 and pulleys 41, 51.

Accordingly, unit 1 provides for high reduction ratios and for the reversal of the rotation direction between gear 45 and roll 5 and between gear 45 and carousel 8 with a reduced number of components. Such reduced number of components results in less maintenance and less noise of the unit 1.

Furthermore, it is necessary to only change the length of belt 50 and the diameter of pulley 51 in order to vary the transmission ratio between carousels 6, 8 and adapt the unit 1 to different values of the pitch between containers 3.

Finally, due to the fact that seats 61, 62 may be indifferently houses either gear 46 or gear 47, roll 5 and carousel 8 may be easily arranged on either one or the other side of carousel 6, without requiring complex mechanical operations.

In other words, unit 1, 1' is highly flexible with reference to the arrangement of roll 5 and carousel 8 relative to carousel 6.

Finally, it is apparent that modifications and variants not departing from the scope of protection of the claims may be made to unit 1, 1'.

For example, unit 1, 1' can comprise either only belt 40 or only belt 50.

The invention claimed is:

1. A unit for applying glue onto a plurality of labels to be cold-glued on respective containers and for conveying such labels applied with glue, comprising:

a roll covered of said glue and operable to rotate about a first axis;

a first carousel operable to rotate in a first direction about a second axis and which comprises, in turn, a plurality of paddles adapted to cooperate with said roll to be applied with said glue and to take a relative label from a storage;

a second carousel operable to rotate in a second direction about a third axis and which comprises, in turn, a plurality of hooks adapted to receive respective labels applied with glue from said respective paddles and to move respective labels with glue applied thereon along a path, wherein the first direction is opposite the second direction;

a first belt operatively connected to said first carousel and to said roll, wherein said first belt is wound onto a first pulley and a second pulley angularly integral with said roll about said first axis;

a second belt operatively connected to said first carousel and said second carousel, wherein said second belt is wound onto a third pulley and a fourth pulley angularly integral with said second carousel about said third axis;

a first gear rotatable about said second axis angularly integral with said first carousel and operatively connected to said first and third pulleys;

a second gear meshing with said first gear, wherein said second gear is angularly integral with said first pulley;

a third gear meshing with said first gear, wherein said third gear is angularly integral respectively with said third pulley; and a stator element fixed with respect to said second axis, said stator element defining:

a first seat is configured to house said first gear;

a second seat is configured to interchangeably house one of said second gear and said third gear to position one of said roll and said second carousel on a first side of said first carousel; and a third seat is configured to interchangeably house the other of said second gear and said third gear to position the other of said roll and said second carousel on a second side of said first carousel, wherein said second seat and said third seat extend externally from said first seat.

2. The unit of claim 1, wherein said stator element is a one-piece element.

3. A labeling machine for cold-gluing labels onto respective containers, comprising:

a storage of labels to be cold-glue onto respective containers;

a unit for applying glue onto a plurality of labels to be cold-glued on respective containers and for conveying such labels applied with clue, the unit including:

a roll covered of said glue and operable to rotate about a first axis, a first carousel operable to rotate in a first direction about a second axis and which comprises, in turn, a plurality of paddles adapted to cooperate with said roll to be applied with said glue and to take a relative label from the storage, and a second carousel operable to rotate in a second direction about a third axis and which comprises, in turn, a plurality of hooks adapted to receive respective labels applied with glue from said respective paddles and to move respective labels with clue applied thereon along a path, wherein the first direction is opposite the second direction at least a first belt operatively connected to said first carousel and to said roll, a second belt operatively connected to said first carousel and said second carousel;

wherein said first belt is wound onto a first pulley and a second pulley angularly integral with said roll about said first axis, and wherein said second belt is wound onto a third pulley and a fourth pulley which is angularly integral with said second carousel about said third axis; and a first gear angularly integral to said first carousel, rotatable about said second axis and operatively connected to said first and third pulleys;

wherein the roll and the second carousel are interchangeably connected to the first carousel;

a conveyor for conveying containers along said path having an application station in common with a release station of said path; and a gluing group for cold-gluing such labels onto respective containers.

* * * * *